US007303190B2

(12) United States Patent
Yamanaka et al.

(10) Patent No.: US 7,303,190 B2
(45) Date of Patent: Dec. 4, 2007

(54) RECORDING APPARATUS INCLUDING AUTOMATIC FEEDING MECHANISM AND AUTOMATIC FEEDING MECHANISM

(76) Inventors: Tsuyoshi Yamanaka, 3-5, Owa 3-chome, Suwa-shi, Nagano-ken (JP); Yuji Miyamoto, 3-5, Owa 3-chome, Suwa-shi, Nagano-ken (JP); Miwa Shimizu, 3-5, Owa 3-chome, Suwa-shi, Nagano-ken (JP)

( * ) Notice: Subject to any disclaimer, the term of this patent is extended or adjusted under 35 U.S.C. 154(b) by 338 days.

(21) Appl. No.: 10/854,784

(22) Filed: May 27, 2004

(65) Prior Publication Data

US 2005/0051943 A1 Mar. 10, 2005

(30) Foreign Application Priority Data

Aug. 12, 2003 (JP) ..... 2003-207353

(51) Int. Cl.
*B65H 1/00* (2006.01)

(52) U.S. Cl. ..... 271/162; 271/213

(58) Field of Classification Search ..... 271/162, 271/213; 400/624; 347/108
See application file for complete search history.

(56) References Cited

U.S. PATENT DOCUMENTS 5,573,235 A * 11/1996 Asai ..... 271/121
5,893,556 A 4/1999 Akahane et al.
5,913,510 A 6/1999 Kiyohara et al.
7,036,813 B2 * 5/2006 Asada ..... 271/117
2003/0052956 A1 3/2003 Katsuyama

FOREIGN PATENT DOCUMENTS

| | | | |
|---|---|---|---|
| EP | 0 675 414 | A2 | 10/1995 |
| JP | 04-189225 | A | 7/1992 |
| JP | 06-083647 | U | 11/1994 |
| JP | 10-181905 | A | 7/1998 |
| JP | 11-263458 | A | 9/1999 |

* cited by examiner

*Primary Examiner*—Patrick Mackey
*Assistant Examiner*—Kaitlin S Joerger

(57) ABSTRACT

A recording apparatus including an automatic feeding mechanism for picking up one of recording media placed on a feed tray one by one and feeding the recording medium is provided. The automatic feeding mechanism includes: the feed tray on which a predetermined number of recording medium can be placed; a hopper for pushing the recording media on the feed tray toward a feed roller; and a separator located in a downstream of the hopper near the hopper. The automatic feeding mechanism picks up the recording media one by one in an order from an uppermost recording medium to a lowermost recording medium and feeds the recording medium thus picked to its downstream by an action of the feed roller and the hopper to sandwich and transfer the recording medium and a separating action of the separator. The automatic feeding mechanism can be rotated around a fulcrum of rotation so as to be foldable.

13 Claims, 7 Drawing Sheets

RECORDING APPARATUS INCLUDING AUTOMATIC FEEDING MECHANISM AND AUTOMATIC FEEDING MECHANISM

This patent application claims priority from a Japanese patent application No. 2003-207353 filed on Aug. 12, 2003, the contents of which are incorporated herein by reference.

BACKGROUND OF THE INVENTION

1. Field of the Invention

The present invention related to a recording apparatus including an automatic feeding mechanism that picks up one of recording media placed on a feed tray one by one. More particularly, the present invention relates to a recording apparatus including a compact automatic feeding mechanism that has a smart appearance, which is capable of preventing entering from foreign objects and being accommodated in the recording apparatus, and such an automatic feeding mechanism.

Moreover, the present invention relates to a liquid ejection apparatus such as an ink-jet recording apparatus for performing recording onto a recording medium (causing liquid to adhere to a medium) by emitting liquid such as ink from its head, and an automatic feeding mechanism used for that liquid ejection apparatus.

The liquid ejection apparatus in the present application means a recording apparatus which uses an ink-jet type recording head and achieves printing on the recording medium by emitting ink from the recording head, such as a printer, a copier and a facsimile machine, as well as an apparatus which uses a liquid ejection head corresponding to the ink-jet type recording head and emits liquid suitable for an application of the apparatus in place of the ink from the ink ejection head to a medium, thereby causing the liquid to adhere to the medium.

Examples of such a liquid ejection head include a color-material ejection head used in fabrication of color filters for a liquid crystal display or the like, an electrode-material (conductive paste) ejection head used in formation of electrodes for an organic EL display or a field emission display (FED), a biological organic material ejection head used in fabrication of bio-chips, and a sample ejection head as a precise pipette, other than the aforementioned recording head.

2. Description of the Related Art

An ink-jet recording apparatus includes an automatic feeding mechanism that includes a feed tray on which a predetermined number of sheets of paper can be stacked and a hopper that pushes up the paper on the feed tray toward a feed roller. The automatic feeding mechanism is also provided with the feed roller that rotates integrally with its rotational shaft. The automatic feeding mechanism picks up one of recording media in an order from the uppermost one to the lowermost one by using an action of nipping and transferring paper by the feed roller and the hopper and a separating action by a separation pad or a retard roller, and then feeds the recording medium thus picked to a recording position below a recording head.

Such an automatic feeding mechanism is secured to a main body of the recording apparatus, as described in Japanese Patent Application Publication (Laid-Open) No. 10-181905, for example, in such a manner that an opening for a feed operation is always provided between the recording apparatus and the automatic feeding mechanism. Thus, that automatic feeding mechanism has a problem of entering of foreign objects, such as dust or dirt. Moreover, the automatic feeding mechanism is arranged at an angle so as to protrude from the rear of the main body of the recording apparatus. Thus, provision of the automatic feeding mechanism prevents the size reduction of the recording apparatus or improvement of the appearance of the recording apparatus.

SUMMARY OF THE INVENTION

Therefore, it is an object of the present invention to provide an automatic feeding mechanism and a recording apparatus including the same and a liquid ejection apparatus including the same, which are capable of overcoming the above drawbacks accompanying the conventional art, in particular, is advantageous to size reduction of the recording apparatus. More specifically, the present invention employs a structure that allows the automatic feeding mechanism to be attached to a main body of the recording apparatus in a movable manner, prevents entering of foreign objects such as dust or dirt from an opening for a feed operation, and can house the automatic feeding mechanism so as to achieve an appearance of the recording apparatus in which the automatic feeding mechanism fits in the shape of the recording apparatus, thereby reducing the size of the recording apparatus and improving the appearance of the recording apparatus. The above and other objects can be achieved by combinations described in the independent claims. The dependent claims define further advantageous and exemplary combinations of the present invention.

According to the first aspect of the present invention, a recording apparatus including an automatic feeding mechanism operable to pick up one of recording media placed on a feed tray one by one and to feed the recording medium, is provided. The automatic feeding mechanism comprises: the feed tray on which a predetermined number of recording media are able to be placed; a hopper operable to push the recording media on the feed tray toward a feed roller; and a separator located in a downstream of the hopper near the hopper. The automatic feeding mechanism picks up one of the recording media one by one in an order from an uppermost recording medium to a lowermost recording medium and feeds the recording medium thus picked to its downstream by an action of the feed roller and the hopper to sandwich and transfer the recording medium and a separating action of the separator, and is rotatable around a fulcrum of rotation to be foldable.

According to the above, the automatic feeding mechanism itself can be rotated around the fulcrum of rotation so as to be folded. Thus, it is prevent the automatic feeding mechanism from projecting from the main body of the recording apparatus when the automatic feeding mechanism is folded, making the automatic feeding mechanism fit in with the outer shape of the main body of the recording apparatus. Therefore, the present invention makes a large contribution to the size reduction of the recording apparatus and the improvement of the appearance of the recording apparatus.

The fulcrum of rotation may be a rotational shaft to which the feed roller is attached.

In this case, parts of the recording apparatus can be effectively used, thus preventing the increase of the cost. Moreover, it is possible to prevent interference of the fulcrum of rotation with various parts attached to the rotational shaft of the feed roller, that may be caused by the rotation of the automatic feeding mechanism.

In the above arrangement, the automatic feeding mechanism may be supported to be freely rotatable with respect to the rotational shaft. The automatic feeding mechanism may be also rotatable within a predetermined range of an angle of rotation to keep positional relationships with the feed roller, the hopper and the separator, that cause no trouble in operations of the feed roller, the hopper and the separator.

In this case, the automatic feeding mechanism can be rotated independently of the rotational shaft of the feed roller. Thus, the automatic feeding mechanism and the rotational shaft are not affected by each other and therefore can perform their own operations. Moreover, since the angle of rotation of the automatic feeding mechanism is set to fall within the predetermined range, it is prevent adverse effects on the positional relationship among the feed roller, the hopper and the separator, which may disrupt their normal operations.

The automatic feeding mechanism may be attached to be rotatable together with the rotational shaft of the feed roller.

In this case, irrespective of the angle of rotation of the automatic feeding mechanism, positional relationships between the automatic feeding mechanism and the feed roller, a hopper-pushing cam for driving hopper or a lever-operating cam for driving a return lever for preventing a overlapped transfer, that is provided to the rotational shaft, as well as a positional relationship between the automatic feeding mechanism with the separator such as a separation pad or a retard roller, can be always kept constant. Thus, no malfunction caused by interference or displacement of the automatic feeding mechanism with any of the above-listed components occurs.

The automatic feeding mechanism may be rotated to close an opening for feeding the recording medium.

In this case, it is prevent foreign objects such as dust or dirt from entering from the opening, thus reducing malfunctions of the recording apparatus and the number of maintenance times.

The automatic feeding mechanism may be able to be switched between a feed position at which an opening for feeding the recording medium is opened and a housed position at which the opening is closed.

In this case, it is possible to place the recording medium on the automatic feeding mechanism by opening the opening for feeding the recording medium when the recording apparatus is used. It is also possible to prevent entering of foreign objects such as dust or dirt by closing the opening when the recording apparatus is not used.

According to the second aspect of the present invention, an automatic feeding mechanism is provided, as recited in the above.

In this case, the same advantageous effects described above can be obtained. That is, it is possible to reduce the size of the recording apparatus, improve the appearance of the recording apparatus and prevent entering of foreign objects such as dust or dirt from the opening for feeding the recording medium.

According to the third aspect of the present invention, a liquid ejection apparatus including an automatic feeding mechanism operable to pick up one of media placed on a feed tray one by one and to feed the medium thus picked is provided. The automatic feeding mechanism comprises: the feed tray on which a predetermined number of media are able to be placed; a hopper operable to push the media on the feed tray toward a feed roller; and a separator located in a downstream of the hopper near the hopper. The automatic feeding mechanism picks up one of the media one by one in an order from an uppermost medium to a lowermost medium and feeds the medium thus picked to its downstream by an action of the feed roller and the hopper to sandwich and transfer the medium and a separating action of the separator, and is rotatable around a fulcrum of rotation to be foldable.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
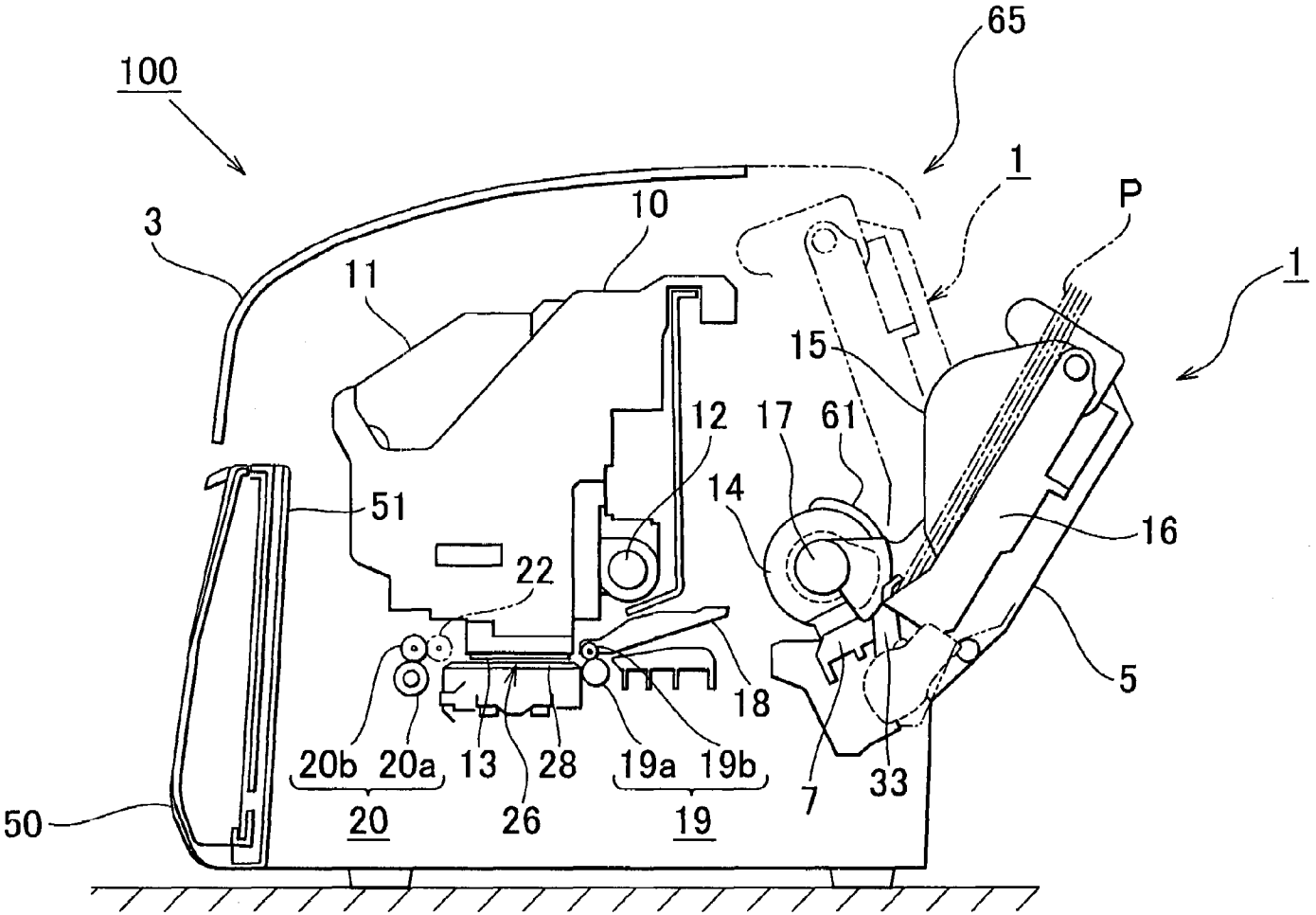
FIG. 1 is a cross-sectional view of an ink-jet recording apparatus according to an embodiment of the present invention, seen from the side thereof.
Figure 2:
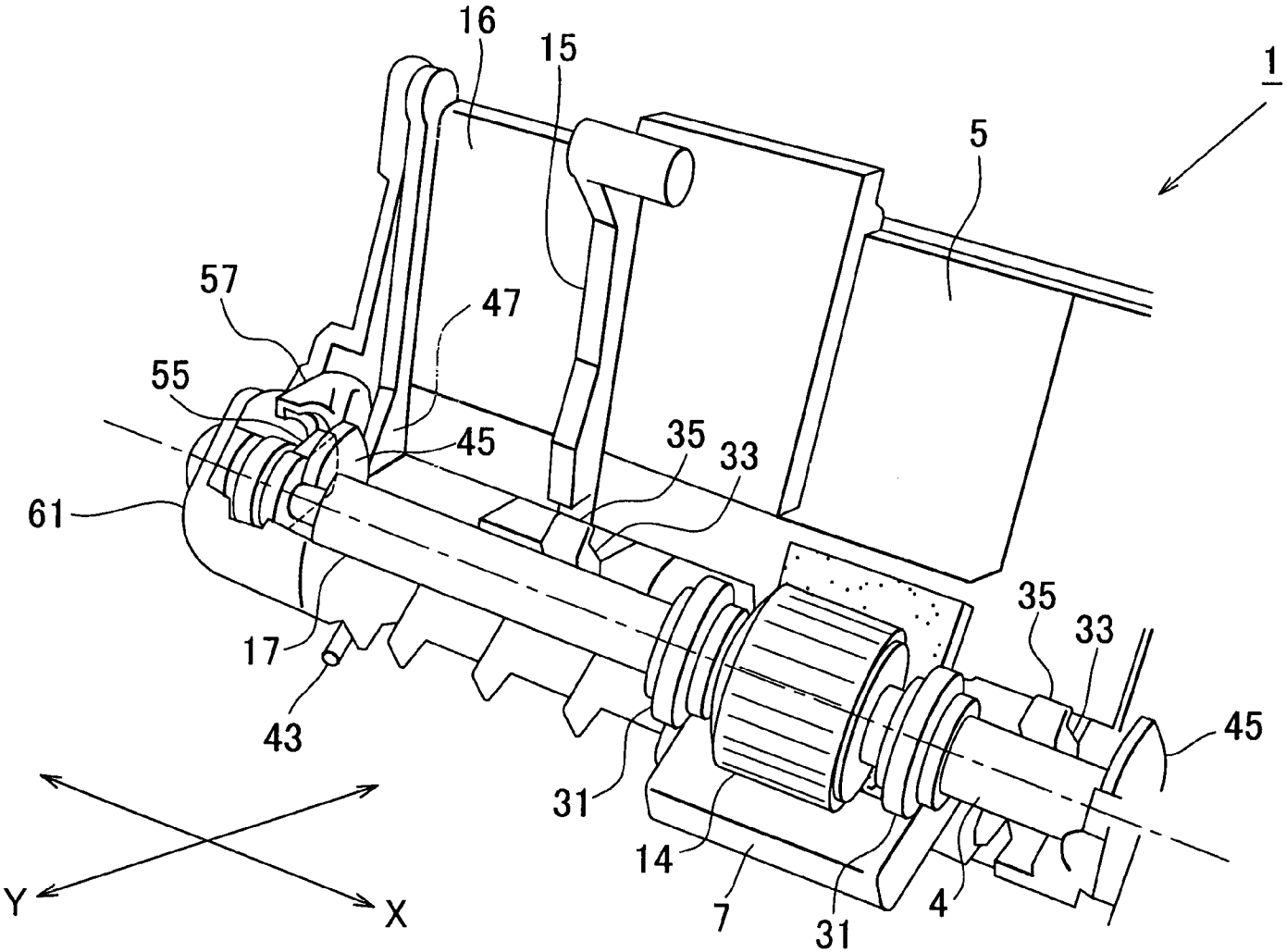
FIG. 2 is a perspective view of an exemplary automatic feeding mechanism according to the present invention, seen from the front.
Figure 3:
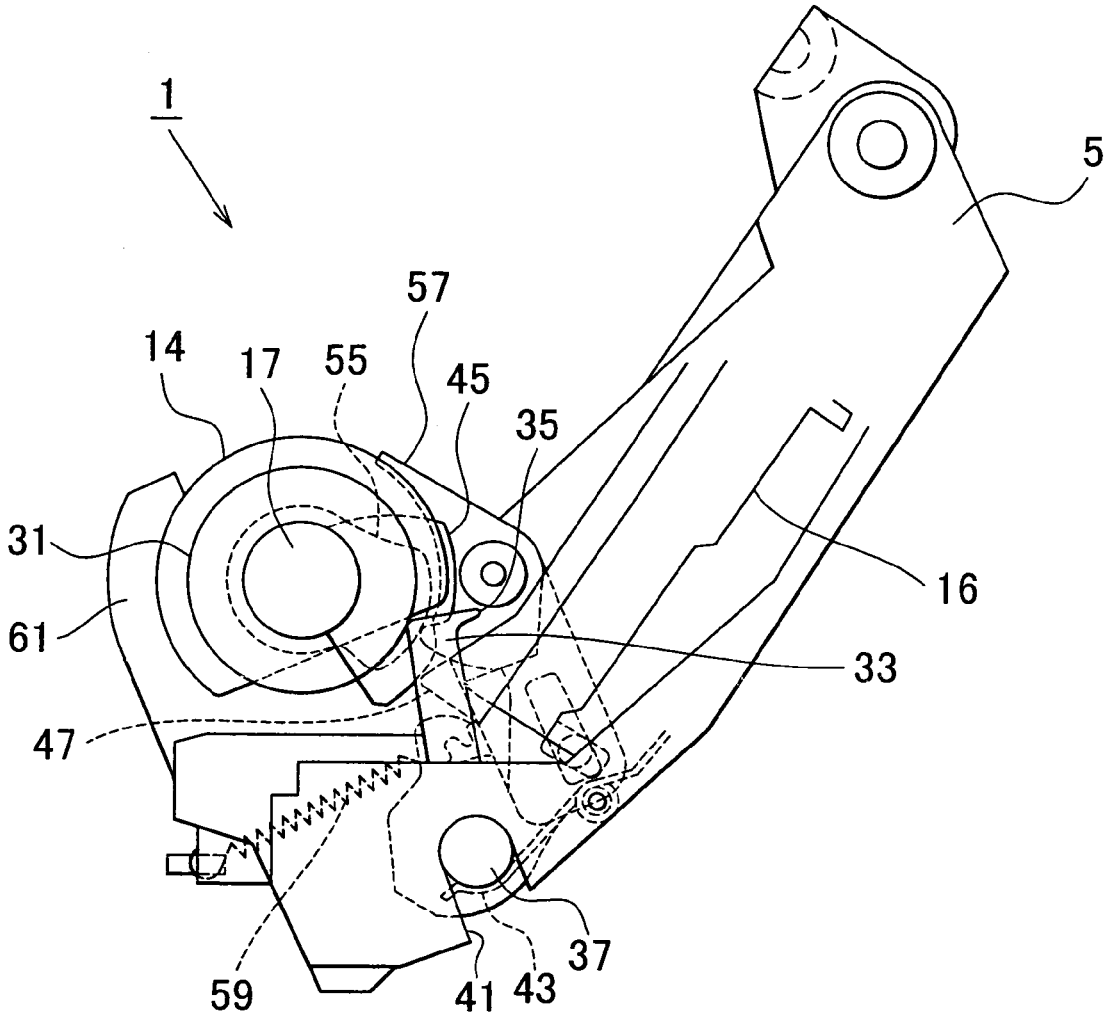
FIG. 3 is a side view of the automatic feeding mechanism shown in FIG. 2.

First, an ink-jet recording apparatus as an example of a recording apparatus that is a typical example of a liquid ejection apparatus of the present invention is generally described referring to FIGS. 1-3. FIG. 1 is a cross-sectional view of the ink-jet recording apparatus, taken along line so as to show a side cross-section thereof. FIG. 2 is a perspective view of an automatic feeding mechanism, seen from the front and FIG. 3 is a side view thereof.

The ink-jet recording apparatus 100 is provided with a carriage 10 as a main component of a recording means as an exemplary liquid ejection means that performs recording onto a recording medium P (hereinafter, simply referred to as paper P) that is an exemplary medium to which liquid is emitted. The carriage 10 is supported by a carriage guide axis 12 in such a manner that the carriage 10 can reciprocate in a main scanning direction X. On the carriage 10 is mounted a recording head 13 as an exemplary liquid ejection head that emits ink as an exemplary liquid to the paper P or the like, thereby performing recording. An ink cartridge 11 as an exemplary liquid cartridge is also attached to the carriage 10.

A platen 28 is provided below the recording head 13, that is opposed to the recording head 13 and defines a gap between the head surface of the recording head 13 and the paper P or the like. Printing onto the paper P or the like is achieved by alternately repeating an operation for transferring the paper P or the like between the carriage 10 and the platen 28 in a sub-scanning direction Y perpendicular to the main scanning direction X by a predetermined transfer amount (distance) and an operating for emitting ink onto the paper P or the like from the recording head 13 during a period in which the recording head 13 reciprocates in the main scanning direction X once.

Next, the structure of the ink-jet recording apparatus 100 is described in more detail in accordance with a transfer path of the paper P. First, in the upstream of any other components in the structure of the recording apparatus 100, a feed tray 5 is provided as an exemplary medium stacking portion onto which paper P is placed. The feed tray 5 is provided with an edge guide 15 that is in contact with the side end of the paper P so as to guide a smooth transfer of the paper P in the sub-scanning direction Y. With rotation of a rotational shaft 17 of a feed roller 14, a hopper 16 goes up at a predetermined timing and therefore the paper P on the feed tray 5 is pushed up toward the feed roller 14.

The feed tray 5, the feed roller 14 and the hopper 16 mentioned above form an automatic feeding mechanism 1 of the present invention. When the feed roller 14 rotates, the automatic feeding mechanism 1 picks up one of one or more sheets of paper P placed in the feed tray 5 one by one in an order from an upper most sheet to a lowermost sheet with the aid of a separation pad 7 as an exemplary separator provided near the feed roller 14, and feeds the picked paper to the downstream in a transfer direction. The characteristic structure of the automatic feeding mechanism 1 of the present invention will be described in detail later.

In the downstream of the feed roller 14, a recording medium detector (not shown) that is an exemplary medium detector that detects the passing of the paper P is provided. Hereinafter, the recording medium detector is simply referred to as a detection lever. In the downstream of the detection lever, transfer rollers 19 formed by a transfer driving roller 19*a* and a transfer driven roller 19*b* are provided. The transfer driven roller 19*b* is supported by its axis in the downstream of a roller holder 18 for the transfer driven roller 19*b*. The roller holder 18 is provided to be rotatable around a rotational center (not shown) and is forced by a twisted coil spring (not shown) to rotate so as to achieve a nip state in which the transfer drive roller 19*b* is always in contact with the transfer driving roller 19*a* while being pressed against the roller 19*a*.

The paper P transferred while being sandwiched between the transfer rollers 19 is directed to a recording position 26 below the recording head 13, where recording is performed in a desired manner on a recording surface of the paper P substantially entirely by the operation of the carriage 10 and the paper P. The gap between the recording head 13 and the platen 28 that is arranged below the recording head 13 to be opposed to the recording head 13, is an important factor of achieving recording with high precision, and can be adjusted appropriately in accordance with the change in thickness of the paper P.

In the downstream of the recording head 13, discharge rollers 20 as an exemplary medium discharge means, formed by a discharge driving roller 20*a* and a discharge toothed roller 20*b* are provided. The paper P discharged by the discharge rollers 20 is discharged onto a site 51 on a discharge stacker 50 as an exemplary medium receiving portion that is arranged in the downstream of the discharge rollers 20.

The discharge toothed roller 20*b* has a plurality of teeth on its outer circumferential surface and is supported by its axis by a roller holder (not shown) provided for the discharge toothed roller 20*b* so as to be freely rotatable. In the upstream of the discharge toothed roller 20*b* is provided an auxiliary toothed roller 22 that is arranged to slightly press paper P downward. The transfer driven roller 19*b* is provided in such a manner that its shaft center is located in the downstream of that of the transfer driving roller 19*b*. The discharge toothed roller 20*b* is provided in such a manner that its shaft center is located in the upstream of that of the discharge driving roller 20*a*.

Due to the structure mentioned above, paper P becomes slightly convex downward between the transfer rollers 19 and the discharge rollers 20 and is pressed against the platen 28 when being located at a position that is opposed to the recording head 13. Thus, lifting the paper P can be prevented and recording can be performed normally. Please note that the auxiliary toothed roller 22 is configured in a similar manner to the discharge toothed roller 20*b* and is supported by its axis by a roller holder (not shown) provided for the auxiliary toothed holder 22.

The structure of the automatic feeding mechanism 1 of the present invention is described in more detail, with a focus on its characteristic parts. As shown in FIG. 2, the feed roller 14 is provided to the rotational shaft 17 at a position on the right of the center of the rotational shaft 17 in its longitudinal direction integrally with the rotational shaft 17. On both sides of the feed roller 14 are provided two guide rollers 31 for achieving a stable feeding of paper P with gaps between the feed roller 14 and the guide rollers 31.

At a position opposed to the feed roller 14, a separation pad 7 is provided that can stop the feeding of one or more sheets of paper P other than the uppermost sheet of paper P so as to separate that sheets from the uppermost sheet, thereby allowing the transfer of the uppermost sheet only, in a case where two or more sheets of paper P on the feed tray 5 are fed simultaneously while being overlapped. On the right and left sides of the guide rollers 31, two return levers 33 are provided that has a function of returning the sheet of paper P other than the uppermost sheet like the separation pad 7.

The return lever 33 is a member provided with a latch claw 35 in form of protruding canopy at its top end. At the base portion of each return lever 33, a rotational shaft 37 extending parallel to the rotational shaft 17 of the feed roller 14 is inserted therethrough. The two return levers 33 and the rotational shaft 37 are arranged so as to rotate as a unit. The two return levers 33 are attached in such a manner that they protrude from window portions provided in the front side of the lower part of the feed tray 5. The rotational shaft 37 engages with an engagement groove 41 formed in the rear side of the lower part of the feed tray 5, as shown in FIG. 3, thereby being always forced by a force applied by a twisted coil spring 43, that is an exemplary forcing means, to cause the return levers 33 to protrude from the aforementioned window portions.

At a position near the end of the rotation axis on the side of each return lever 33, a hopper-pushing cam 45 having a fan-like shape seen from the side thereof is provided. Those two hopper-pushing cams 45 are provided integrally with the rotational shaft 17. In addition, a cam-follower 47 having a shape of a right triangle seen from the side thereof is provided at a position opposed to each hopper-pushing cam 45. Each cam-follower 47 is formed by extending the right or left side plate of the hopper 16.

Outside the left hopper-pushing cam 45, a lever-operating cam 55 is provided integrally with the rotational shaft 17 next to the hopper-pushing cam 45. The lever-operating cam 55 is substantially rectangular at its top end and is semicircular in the base portion, when seen from the side thereof.

This lever-operating cam 55 has an action of rotating a cam-action plate 57 arranged at a position opposed to the lever-operating cam 55 by a predetermined angle by coming into contact with the cam-action plate 57, thus rotating the return lever 33 in a return direction against a pulling force applied by a tension coil spring 59.

As the characteristic structure of the present invention, shaft bearing portions 61 are provided which fit with the rotational shaft 17 to which the feed roller 14 is attached, to be freely rotatable. The shaft bearing portions 61 are formed by extending the right and left side plates of the feed tray 5. Thus, the automatic feeding mechanism 1 is arranged to be rotatable around the rotational shaft 17 as a fulcrum of rotation independently of the rotational shaft, thereby being foldable.

The feed tray 5 is provided with the cam-action plate 57 and the separation pad 7, and the hopper 16 is provided with the cam-follower 47. Each of these components normally operate when coming into contact with or keeping an appropriate positional relationship with the feed roller 14, the hopper-pushing cam 45 or the lever-operating cam 55 provided to the rotational shaft 17. Thus, a range of an angle of rotation of the automatic feeding mechanism 1 is set so as to keep the positional relationship that causes no trouble in the operations of the respective components. In the present embodiment, this range is set to be approximately 55° or less.

Figure 4A:
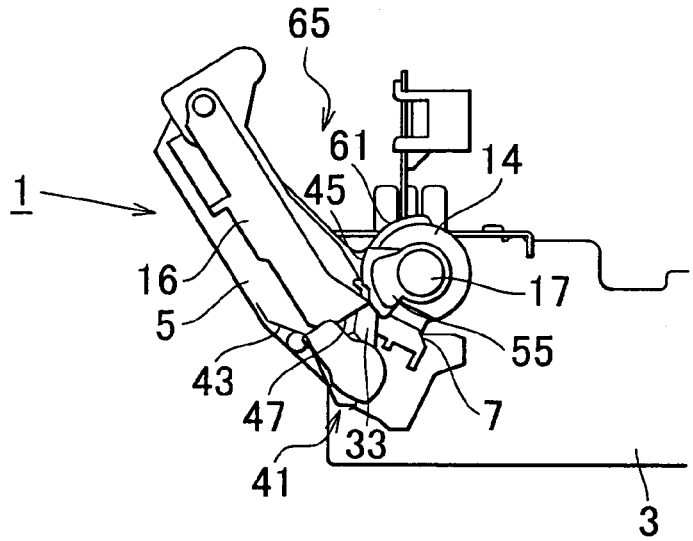
FIGS. 4A-4C are cross-sectional views of the automatic feeding mechanism, seen from the side thereof, showing operating states of the automatic feeding mechanism stepwise.
Figure 4B:
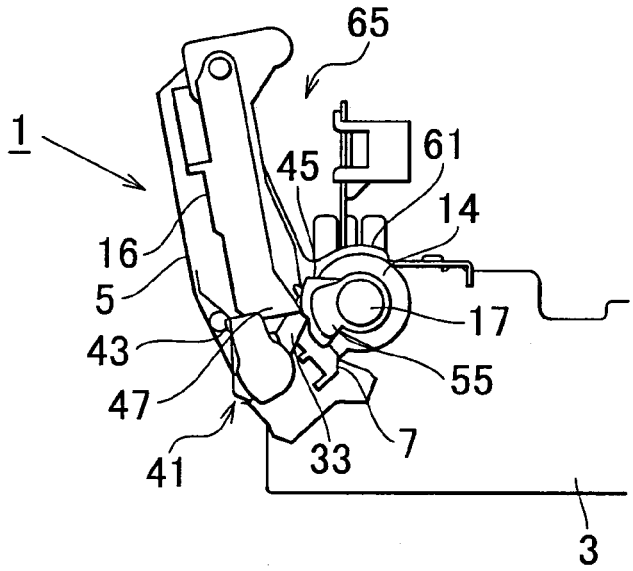
Figure 4C:
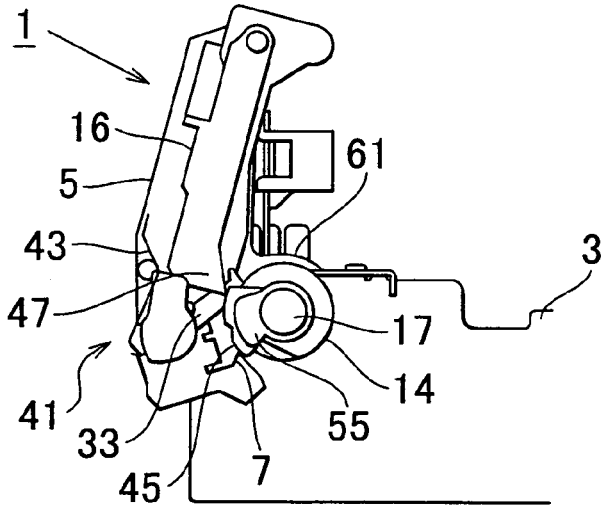

Next, an operating state of the automatic feeding mechanism 1 of the present invention and the associated change of the outer shape of the recording apparatus 100 are described. FIGS. 4A-4C are side views respectively showing three operating states of the automatic feeding mechanism. FIGS. 4A-4C show rotation of the automatic feeding mechanism from an opened state to a closed state stepwise. FIG. 4A shows the opened state; FIG. 4B shows an intermediate state between the opened state and the closed state; and FIG. 4C shows the closed state. Moreover, FIG. 5 is a perspective view showing a part of the rear of the recording apparatus when the automatic feeding mechanism is opened, and FIG. 6 is a perspective view of the recording apparatus seen from the back when the automatic feeding mechanism is closed.

Figure 5:
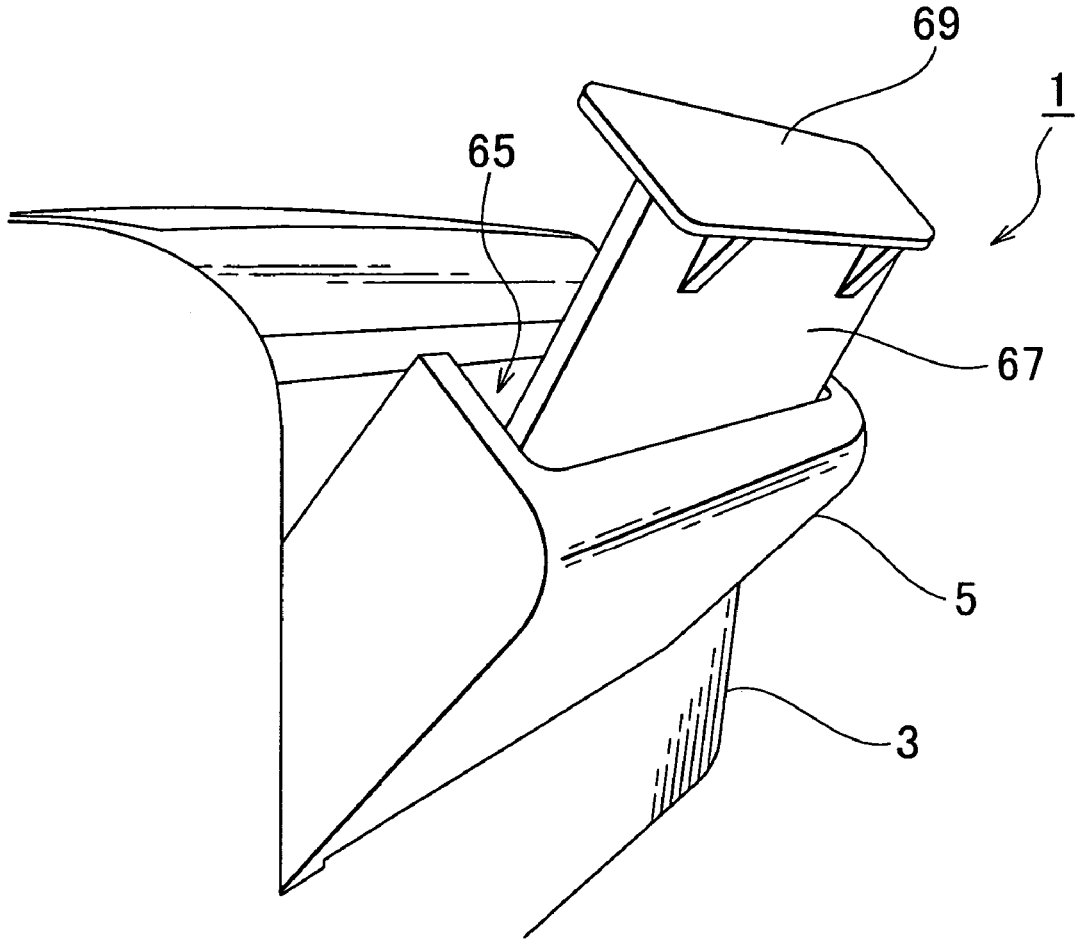
FIG. 5 is a perspective view of the recording apparatus when the automatic feeding mechanism is spread out.
Figure 6:
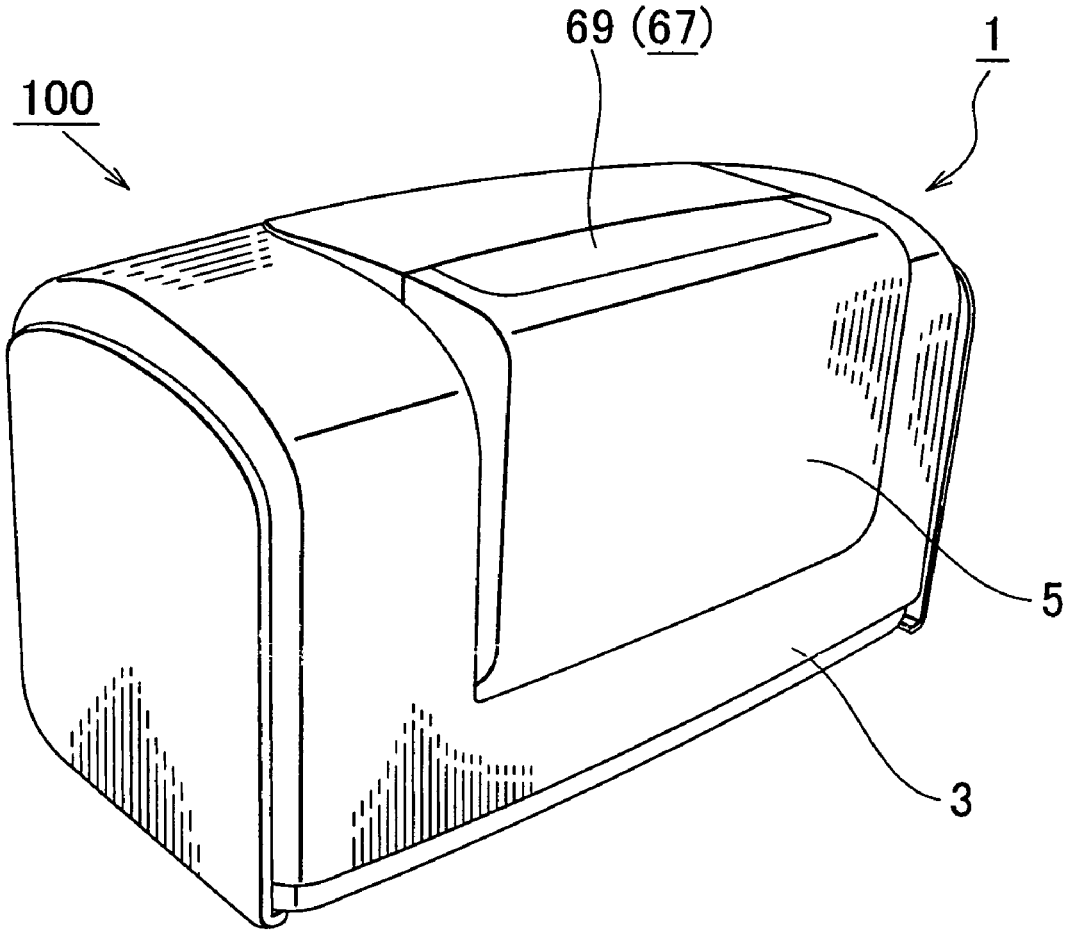
FIG. 6 is a perspective view of the recording apparatus when the automatic feeding mechanism is closed.

(1) Opened State (See FIGS. 4A and FIG. 5)

In this state, the automatic feeding mechanism 1 is opened to be located at a feed position at which an opening for a feed operation 65 is completely opened and paper P can be placed on the automatic feeding mechanism 1. The automatic feeding mechanism 1 projects from the main body 3 of the recording apparatus 1, as shown in FIG. 5. A user pulls out an extension tray 67, that is provided to be slidable with respect to the feed tray 5, upward and then places paper P on the extension tray 67.

(2) Intermediate State (See FIG. 4B).

In this state, the hopper 16, the return levers 33, the separation pad 7 and the like that are provided on the feed-tray side are rotated with the feed tray 5 around the rotational shaft 17 as the fulcrum of rotation, independently of the rotational shaft 17. Thus, even when the feed tray 5 rotates, the rotational shaft 17 does not rotate. Therefore, as shown in FIG. 4B, that rotation of the feed tray 5 does not change the rotational angles of the lever-operating cam 55, the hopper-pushing cam 45 and the feed roller 14.

(3) Closed State (See FIGS. 4C and 6)

In this state, the automatic feeding mechanism 1 is located at a housed position at which the opening 65 is completely closed and the automatic feeding mechanism 1 fits in the outer shape of the main body 3 of the recording apparatus. In this state, the extension tray 67 is housed within the feed tray 5, as shown in FIG. 6, and the opening 65 is closed with a flap 69 provided at the top end of the extension tray 67. Thus, there is no protrusion that has an adverse effect on the appearance of the recording apparatus, achieving a compact and smart recording apparatus. In addition, since the opening 65 is closed, entering of foreign objects such as dust or dirt can be prevented.

Although the automatic feeding mechanism and the recording apparatus including it of the present invention have the aforementioned structures basically, changes or omissions of components can be performed without departing from the scope of the present invention. For example, the automatic feeding mechanism 1 can be attached in such a manner that it can rotate together with the rotational shaft 17 of the feed roller 14. However, in this case, a clutch mechanism has to be provided that can temporarily disconnect the rotational shaft 17 and the automatic feeding mechanism 1 so as to allow the automatic feeding mechanism 1 to rotate in a predetermined direction, at least at the feed position where the automatic feeding mechanism 1 is opened.

Figure 7A:
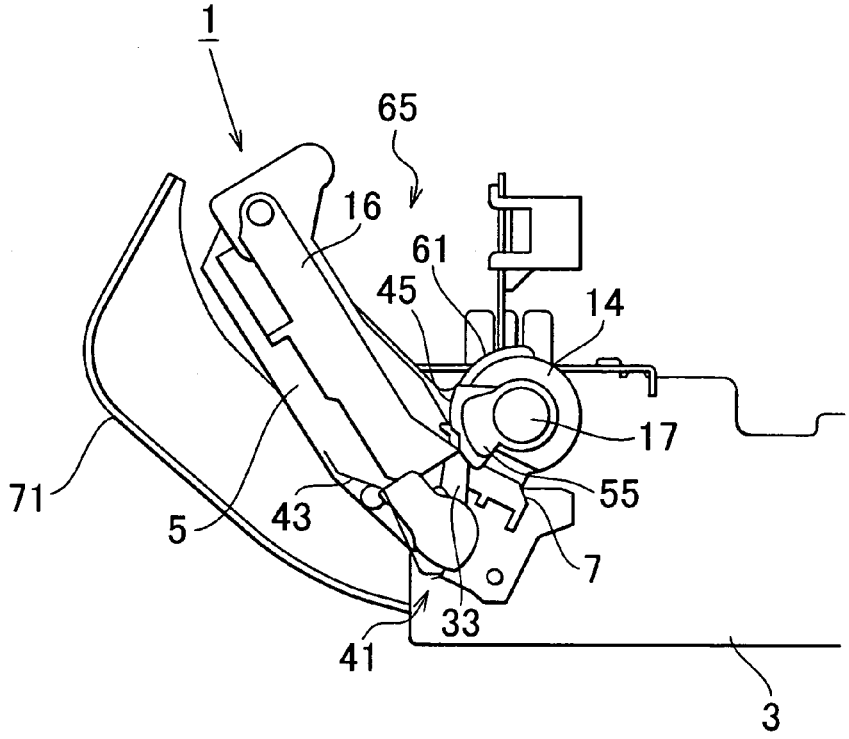
FIGS. 7A and 7B are cross-sectional views of another exemplary automatic feeding mechanism according to the present invention.
Figure 7B:
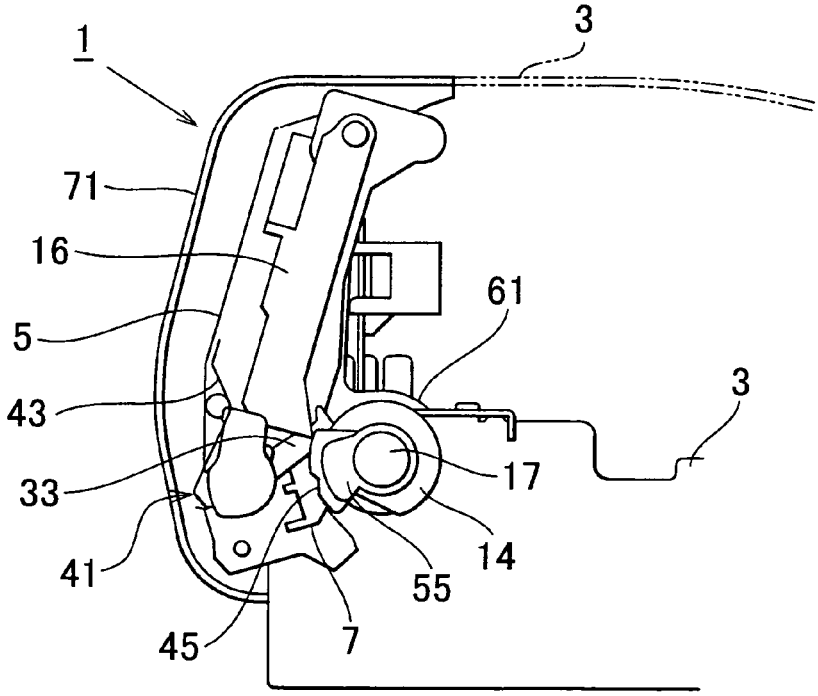

In a case where this structure is employed, the positional relationships among the feed roller 14, the hopper 16, the separation pad 7 and the like are always kept constant. Thus, no malfunction caused by interference or displacement between the components, occurs. Alternately, as shown in FIGS. 7A and 7B, a structure including a cover 71 outside the feed tray 5 may be employed as another means for closing the opening 65. In the shown example, the cover 71 is spread out more widely than the feed tray 5 in the opened state, as shown in FIG. 7A, so as to allow paper P to be placed easily. In the closed state, the cover 71 closes, together with the feed tray 5, the opening 65.

Although the present invention has been described by way of exemplary embodiments, it should be understood that those skilled in the art might make many changes and substitutions without departing from the spirit and the scope of the present invention which is defined only by the appended claims.

What is claimed is:

1. An automatic feeding mechanism operable to pick up one of recording media placed on a feed tray one by one and to feed said recording medium, said automatic feeding mechanism comprising: said feed tray on which a predetermined number of recording media are able to be placed; a hopper operable to push said recording media on said feed tray toward a feed roller; and a separator located in a downstream of said hopper near said hopper, wherein said automatic feeding mechanism picks up one of said recording media one by one in an order from an uppermost recording medium to a lowermost recording medium and feeds said recording medium thus picked to its downstream by an action of said feed roller and said hopper to sandwich and transfer said recording medium and an action of said separator to separate the uppermost recording medium from the predetermined number of said recording media on said feed tray, and said automatic feeding mechanism is rotatable around a fulcrum of rotation to be foldable, such that said hopper, said feed tray, and said separator revolve around said fulcrum.

2. An automatic feeding mechanism operable to pick up one of recording media placed on a feed tray one by one and to feed said recording medium, said automatic feeding mechanism comprising: said feed tray on which a predetermined number of recording media are able to be placed; a hopper operable to push said recording media on said feed tray toward a feed roller; and a separator located in a downstream of said hopper near said hopper, wherein said automatic feeding mechanism picks up one of said recording media one by one in an order from an uppermost recording medium to a lowermost recording medium and feeds said recording medium thus picked to its downstream by an action of said feed roller and said hopper to sandwich and transfer said recording medium and an action of said separator to separate said recording media and said automatic feeding mechanism is rotatable around a fulcrum of rotation to be foldable, such that said hopper, said feed tray, and said separator revolve around said fulcrum, wherein said fulcrum of rotation is a rotational shaft to which said feed roller is attached.

3. An automatic feeding mechanism as claimed in claim 2, wherein said automatic feeding mechanism is attached to be freely rotatable with respect to said rotational shaft, and is rotatable within a predetermined range of an angle of rotation to keep positional relationships with said feed roller, said hopper and said separator, that cause no trouble in operations of said feed roller, said hopper and said separator.

4. An automatic feeding mechanism as claimed in claim 2, wherein said automatic feeding mechanism is attached to be rotatable together with said rotational shaft of said feed roller.

5. An automatic feeding mechanism as claimed in claim 1, wherein said automatic feeding mechanism is rotated to close an opening for feeding said recording medium.

6. An automatic feeding mechanism as claimed in claim 1, wherein said automatic feeding mechanism is to be switched between a feed position at which an opening for feeding said recording medium is opened and a housed position at which said opening is closed.

7. A recording apparatus using an automatic feeding mechanism as claimed in claim 1.

8. A liquid ejection apparatus including an automatic feeding mechanism operable to pick up one of media placed on a feed tray one by one and to feed said medium thus picked, said automatic feeding mechanism comprising: said feed tray on which a predetermined number of media are able to be placed; a hopper operable to push said media on said feed tray toward a feed roller; and a separator located in a downstream of said hopper near said hopper, wherein said automatic feeding mechanism picks up one of said media one by one in an order from an uppermost medium to a lowermost medium and feeds said medium thus picked to its downstream by an action of said feed roller and said hopper to sandwich and transfer said medium and an action of said separator to separate the uppermost recording medium from the predetermined number of said recording media on said feed tray, and said automatic feeding mechanism is rotatable around a fulcrum of rotation to be foldable, such that said hopper, said feed tray, and said separator revolve around said fulcrum.

9. An automatic feeding mechanism as claimed in claim 1, wherein positional relationship between said hopper, said feed tray, and said separator remains constant when said automatic feeding mechanism is rotated around said fulcrum.

10. A liquid ejection apparatus as claimed in claim 8, wherein positional relationship between said hopper, said feed tray, and said separator remains constant when said automatic feeding mechanism is rotated around said fulcrum.

11. An automatic feeding mechanism as claimed in claim 1, wherein said fulcrum of rotation is a rotational shaft to which said feed roller is attached.

12. An automatic feeding mechanism as claimed in claim 11, wherein said automatic feeding mechanism is attached to be freely rotatable with respect to said rotational shaft, and is rotatable within a predetermined range of an angle of rotation to keep positional relationships with said feed roller, said hopper and said separator, that cause no trouble in operations of said feed roller, said hopper and said separator.

13. An automatic feeding mechanism as claimed in claim 11, wherein said automatic feeding mechanism is attached to be rotatable together with said rotational shaft of said feed roller.

* * * * *

UNITED STATES PATENT AND TRADEMARK OFFICE

CERTIFICATE OF CORRECTION

PATENT NO. : 7,303,190 B2
APPLICATION NO. : 10/854784
DATED : December 4, 2007
INVENTOR(S) : Tsuyoshi Yamanaka It is certified that error appears in the above-identified patent and that said Letters Patent is hereby corrected as shown below:

On the Title Page, Item (73) Please insert (73) Assignee: Seiko Epson Corporation, Tokyo (JP)

Signed and Sealed this

Thirteenth Day of January, 2009

JON W. DUDAS
*Director of the United States Patent and Trademark Office*